US006620569B2

(12) United States Patent
Tsubuko et al.

(10) Patent No.: US 6,620,569 B2
(45) Date of Patent: Sep. 16, 2003

(54) LIQUID RECORDING MATERIAL

(75) Inventors: Kazuo Tsubuko, Shizuoka (JP); Tsuyoshi Asami, Kanagawa (JP); Aiko Ishikawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/170,910

(22) Filed: Jun. 12, 2002

(65) Prior Publication Data

US 2003/0065064 A1 Apr. 3, 2003

Related U.S. Application Data

(63) Continuation of application No. 09/943,448, filed on Aug. 30, 2001, now abandoned, which is a continuation of application No. 09/472,575, filed on Dec. 27, 1999, now abandoned.

(30) Foreign Application Priority Data

Jan. 8, 1999 (JP) ..... 11-003488

(51) Int. Cl.[7] ..... G03G 9/135

(52) U.S. Cl. ..... 430/115; 106/31.13; 106/31.41; 106/31.6; 347/100

(58) Field of Search ..... 430/115; 106/31.13, 106/31.41, 31.6; 347/100

(56) References Cited

U.S. PATENT DOCUMENTS

| | | | |
|---|---|---|---|
| 5,300,390 A | 4/1994 | Landa et al. | 430/115 |
| 6,084,006 A | 7/2000 | Kashiwazaki et al. | 523/160 |

*Primary Examiner*—Mark A. Chapman
(74) *Attorney, Agent, or Firm*—Cooper & Dunham LLP

(57) ABSTRACT

A liquid recording material containing at least a carrier liquid, a resin, a coloring agent, and a reactive silicone material, an image transfer sheet for use with the liquid recording material, and a method of fixing images, using the liquid recording material, are disclosed.

18 Claims, No Drawings

LIQUID RECORDING MATERIAL

CROSS REFERENCE TO RELATED APPLICATIONS

This application is a continuation of application Ser. No. 09/943,448 filed Aug. 30, 2001 now abandoned which is a continuation of application Ser. No. 09/472,575, filed Dec. 27, 1999, now abandoned

BACKGROUND OF THE INVENTION

1. Field of the Invention

The present invention relates to a liquid recording material which may be used as a liquid developer such as an electrophotographic developer, for use in wet-type recording apparatus such as an electrophotographic apparatus, a printer, or for use in ink-jet recording apparatus, and which liquid recording material may also be used as a printing ink.

2. Discussion of Background

It is conventionally known that silicone resin is used as a component for an electrophotographic developer. For example, in Japanese Laid-Open Patent Application 53-57039, there is disclosed a development method conducted by coating a development roller with a liquid developer with a viscosity of 3 to 1,000 cp, a solid component content of 0.5 to 50 wt. %, and a particle size of 0.5 to 5 $\mu$m (silicone toner with high viscosity and high solid component content, containing silicone oil with high viscosity).

Japanese Laid-Open Patent Application 3-171149 discloses a silicone toner prepared by using a vinyl polymer which contains a cross-linking agent in an amount of 0.005 wt. % or more.

Japanese Laid-Open Patent Application 3-171150 discloses a silicone toner which contains a rosin-based polymer with a molecular weight of 2000 to 40000 and a softening point of 50 to 190° C.

Japanese Laid-Open Patent Application 3-171151 discloses a silicone toner prepared by using a polymer which is prepared by cross-linking a carboxyl-group-containing vinyl polymer with amine.

Furthermore, Japanese Laid-Open Patent Application 3-200263 discloses a silicone toner which contains erucamide.

Japanese Laid-Open Patent Application 3-200264 discloses a silicone toner containing a vinyl polymer with a weight-average molecular weight/number-average molecular weight ratio of 4 or more.

Japanese Laid-Open Patent Application 3-200265 discloses a silicone toner comprising a self-crosslinking polymer and a crosslinked polymer.

Japanese Laid-Open Patent Application 3-225356 discloses a silicone toner comprising a crosslinked polyester.

Japanese Laid-Open Patent Application 3-225357 discloses a silicone toner prepared by using a polymer with part of a main chain or a side chain thereof being connected by an acid-base mutual action.

Japanese Laid-Open Patent Application 3-225358 discloses a silicone toner prepared by using a methylol-group-containing resin and a resin which is reactive with the methylol-group-containing resin.

Japanese Laid-Open Patent Application 3-225361 discloses a silicone toner comprising a polyolefin with a melt index of 25 to 700.

Japanese Laid-Open Patent Application 3-225364 discloses a silicone toner comprising a polyolefin with an AV of 0.5 or more, and a melt viscosity of 50 to 15,000 cp at 200° C.

Japanese Laid-Open Patent Application 4-88357 discloses a silicone toner with a viscosity of 1 to 50 cp at 100° C. and a critical surface tension of 18 to 36 dynes/cm when the solid component thereof is 10 wt. %.

Japanese Laid-Open Patent Application 3-199204 discloses a toner prepared by using a silicone oil as a polymerization catalyst.

Japanese Laid-Open Patent Application 3-223302 discloses a method of producing a toner by polymerizing a toner preparation material which is prepared by dissolving or dispersing a vinyl monomer in a silicone oil with a viscosity of 10000 CS or less.

Japanese Laid-Open Patent Application 3-292352 discloses the use as a toner of a non-aqueous dispersion liquid which contains a polymer which is prepared from at least (a) one resin which is insoluble in silicone oil and (b) a monomer which dissolves the resin.

Japanese Laid-Open Patent Application 3-171152 discloses a toner composed of a fluorine-based solvent, an aliphatic hydrocarbon and a silicone solvent.

Japanese Laid-Open Patent Application 4-199064 discloses the use of a concentrate toner by diluting the concentrate toner with a dilution liquid comprising as the main component a silicone oil.

Japanese Laid-Open Patent Application 53-57039 discloses a silicone toner with a viscosity of 3 to 1000 CS, a solid component content of 0.5 to 50 wt. %, and a particle size of 0.3 to 5 $\mu$m.

Japanese Laid-Open Patent Application 3-199204 and Japanese Laid-Open Patent Application 3-223302 disclose a method of producing a toner by polymerizing a vinyl monomer in silicone oil.

Furthermore, there is known an electrophotographic liquid developer which is prepared by dispersing a toner which comprises as the main components a thermoplastic resin such as styrene resin or acrylic resin, and a coloring agent comprising a pigment such as carbon black or a dye, in a carrier liquid such as silicone oil, vegetable oil, or an aliphatic hydrocarbon solvent as disclosed, for instance, in Japanese Laid-Open Patent Application 55-35321.

As a recording method, using the above-mentioned liquid developer, there is known an intermediate-image-transfer recording method comprising the steps of forming a latent electrostatic image on the surface of a photoconductor, developing the latent electrostatic image to a visible toner image with the liquid developer, transferring the toner image to an intermediate image transfer belt, and transferring the toner image to a recording sheet, as disclosed, for instance, in U.S. Pat. No. 4,708,460.

A method of directly transferring the toner image to the recording sheet, without using the intermediate image transfer belt, is also known. In ink-jet inks and printing inks, water, various solvents, coloring agents, resins and dispersing agents are used.

The above-mentioned conventional recording methods using the liquid developers have the problems that when the boiling point of the carrier liquid for use in the developers is high, for instance, when an aliphatic hydrocarbon solvent such as silicone oil or a vegetable oil is used as the carrier liquid, the carrier liquid is held on the image transfer sheet and is difficult to evaporate, and the odor of the carrier liquid stays particularly when the boiling point of the carrier liquid is high, and that image fixing cannot be performed properly.

The above-mentioned intermediate-image-transfer recording method has the shortcomings that image transfer efficiency is low, images with sufficiently high density cannot be obtained on a recording paper, and images with clear contours cannot be obtained.

In the above-mentioned intermediate-image-transfer recording method, the image transfer from the intermediate image transfer belt to the recording sheet is carried out with the application of pressure to both the recording sheet and the intermediate image transfer belt. In order to produce sufficient adhesion between the toner image and the recording sheet for use in practice, it is required to increase the above-mentioned pressure. However, in apparatus used in practice, there is a limit to the pressure that can be applied so that sufficient adhesion for use in practice cannot always be obtained and therefore the image transfer efficiency is low.

In conventional copying machines and printers, a heat roller or a heat plate is used as a heat source for fixing toner images, so that such conventional copying machines and printers have the shortcoming that power consumption is large.

Furthermore, developers in which silicone oil is used as the carrier liquid therefor have the shortcoming that they lack preservation stability because silicone oil is non-polar and therefore the dispersibility thereof is poor.

Furthermore, the use of silicone oil as a component for electrophotographic developers and recording materials has been conventionally proposed, for example, as disclosed in Japanese Laid-Open Patent Applications 3-171149, 3-171151 and 3-171152, in which the use of dimethyl silicone oil is specifically proposed.

However, cyclic polysiloxanes, for example, commercially available polysiloxanes (Trademark "KF994", "KF995", made by Shin-Etsu Chemical Co., Ltd.), have a low molecular weight and a low viscosity, so that the evaporation thereof is rapid, but have the problem of causing improper electric contact.

On the other hand, silicone oils having high molecular weight, such as KF96-10CS, 50CS, 100CS, 300CS, 1000CS, 5000CS, and 50000CS, are difficult to evaporate and therefore have no problem with respect to electric contact, but remain in copying paper, and cause image fixing performance to deteriorate, and ooze out of the copy paper, smearing the copy paper. When toner images are formed on an OHP (overhead projector) film, using the above silicone oils, the toner images are difficult to fix and become sticky.

SUMMARY OF THE INVENTION

It is therefore a first object of the present invention to provide a liquid recording material which is capable of solving the above-mentioned conventional problems when the carrier liquid with high boiling point is used, and has no environmental pollution problems, with the safety to health taken into consideration.

A second object of the present invention is to provide a recording material which has the features of the above-mentioned liquid recording material and is capable of forming toner images with a sufficiently high density for use in practice and with clear contours on a recording sheet, with the application of small pressure thereto in a recording apparatus using the above-mentioned intermediate image transfer method.

A third object of the present invention is to provide a recording material with the features of the above-mentioned recording materials, and also with the features that the above-mentioned improper electric contact is not caused, and the silicone oil is prevented from oozing from the copying paper after coping or printing, and images with high image quality can be obtained with high dot reproduction.

A fourth object of the present invention is to provide an image transfer material for use with the above recording material.

A fifth object of the present invention is to provide a method of promoting the fixing of images developed by the above liquid recording material of the present invention.

The first to third objects of the present invention can be achieved by a liquid recording material comprising a carrier liquid, a resin, a coloring agent, and a reactive silicone material.

In particular, in the present invention, by use of the reactive silicone material in the carrier liquid, the silicone oil is prevented from oozing from the copying paper after coping or printing, and the above-mentioned improper electric contact can be prevented from occurring by the chemical reaction or physical adsorption of the reactive silicone material.

Further, by use of the reactive silicone material in the resin and/or the coloring agent, images with high image quality and high dot reproduction can also be obtained by the chemical reaction or physical adsorption of the reactive silicone material.

In the above-mentioned liquid recording material of the present invention, it is preferable that the reactive silicone material comprise such a reactive silicone compound that contains in the molecule thereof at least one group selected from the group consisting of vinyl group, amino group, hydroxyl group, epoxy group, isocyanate group, and an active hydrogen.

In the liquid recording material of the present invention, the reactive silicone material may be contained in at least one of the carrier liquid, the resin, or the coloring agent.

The reactive silicone material for use in the carrier liquid, the resin and the coloring agent may comprise a silicone RTV rubber.

The carrier liquid may comprise the reactive silicone material and a polymerizable vinyl monomer, with the weight ratio of the reactive silicone material: the polymerizable vinyl monomer being in a range of (0.01 to 9): 1.

The carrier liquid may also comprise the reactive silicone material and at least one component selected from the group consisting of an aliphatic hydrocarbon, a vegetable oil, a synthetic oil, and a silicone oil.

The carrier liquid may further comprise a polymerization initiator.

The carrier liquid may further comprise at least one component selected from the group consisting of a gelling agent and a cross-linking agent.

As the coloring agent for use in the present invention, for instance, a yellow coloring agent, a magenta coloring agent, a cyan coloring agent, and a black coloring agent can be employed. The yellow coloring agent may comprise a disazo pigment, the magenta coloring agent may comprise a quinacridone pigment or a carmine pigment, the cyan coloring agent may comprise copper phthalocyanine, and the black coloring agent may comprise carbon black.

The liquid recording material of the present invention may further comprise at least one component selected from the group consisting of an oxidizing agent, a reducing agent, an esterification agent, a coupling agent, a gelling agent, and a polymerization initiator.

The fourth object of the present invention can be achieved by an image transfer material comprising at least on the surface thereof at least one component selected from the group consisting of an oxidizing agent, a reducing agent, an esterification agent, a coupling agent, a gelling agent, and a polymerization initiator.

The fifth object of the present invention can be achieved by a method of fixing an image developed by using the above-mentioned liquid recording material of the present invention which comprises the carrier liquid, the resin, the coloring agent, and the reactive silicone material, on the above-mentioned image transfer material of the present invention which comprises at least on the surface thereof at least one component selected from the group consisting of an oxidizing agent, a reducing agent, an esterification agent, a coupling agent, a gelling agent, and a polymerization initiator, with the application of corona charge thereto as an external stimulus.

DESCRIPTION OF THE PREFERRED EMBODIMENTS

As mentioned above, the liquid recording material of the present invention comprises the carrier liquid, the resin, the coloring agent, and the reactive silicone material.

The carrier liquid may comprise the reactive silicone material and an aliphatic hydrocarbon.

Representative examples of the aliphatic hydrocarbon for use in the carrier liquid are isododecane, isononane, and commercially available aliphatic hydrocarbon carrier liquid such as "Isopar G", "Isopar H", "Isopar L", "Isopar M" and "Isopar V" (Trademarks), made by Exxon Chemical Japan Ltd., which may be used in the form of a mixture.

The carrier liquid may also comprise the reactive silicone material and a vegetable oil.

Representative examples of the vegetable oil are soybean oil, cottonseed oil, safflower oil, sunflower oil, camellia oil, colza oil, Kanora oil, castor oil, linseed oil and olive oil.

When such vegetable oils are subjected to alkali purification, modification, or heat treatment, the pigment dispersibility thereof is so improved that image density, image resolution and image fixing performance can be improved. It is preferable that such a dispersing medium for the carrier liquid be a non-polar, highly insulating and odorless liquid.

The carrier liquid may also comprise the reactive silicone material and a synthetic oil.

Representative examples of the synthetic oil are fatty esters obtained by the reaction between higher fatty acid and alcohol, and ester compounds obtained by the reaction between higher fatty acid and ethylene glycol or glycerin.

The carrier liquid may also comprise the reactive silicone material and a silicone oil such as dimethyl silicone oil.

By use of the mixture of the reactive silicone material and the silicone oil such as dimethyl silicone oil in the carrier liquid, the cost of the liquid recording material can be reduced, and the water resistance and the solvent resistance of the liquid recording material of the present invention can be improved.

The carrier liquid may also comprise the reactive silicone material and a polymerization initiator.

In this case, a small amount of an initiator, such as AIBN, BPO, ammonium persulfate or hydrogen peroxide, is added to the reactive silicone material, and the reactive silicone material is polymerized after copies are made so that the image fixing performance can be improved.

The carrier liquid may also further comprise at least one component selected from the group consisting of a gelling agent and a cross-linking agent in addition to the reactive silicone material.

Representative examples of the gelling agent are 12-hydroxystearic acid and calcium oleate, which may be added in an amount of about 0.1 to 20 parts by weight to 100 parts by weight of the carrier liquid, whereby the dispersibility and the image fixing performance of the recording material can be improved. The same effect as mentioned above can be obtained by using a cross-linking agent instead of the gelling-agent.

The liquid recording material of the present invention may further comprise at least one component selected from the group consisting of an oxidizing agent, a reducing agent, an esterification agent, a coupling agent, a gelling agent, and a polymerization initiator.

As the oxidizing agent, for example, metal salts of naphthenic acid can be employed. As the reducing agent, for example, various kinds of metal powders, such as zinc powder, can be employed. As the esterification agent, for example, an acid or basic organic material can be employed. As the coupling agent, a silane coupling agent and a metal titanate coupling agent can be employed. As the polymerization initiator, for example, AIBN, BPO, PERBUTYL-O, and KAYAESTER-O can be employed. By containing any of the above components in the liquid recording material, the component reacts with the reactive silicone material in the recording material, so that the image fixing performance and the dispersibility of the liquid recording material are improved. When a silicone oil is used in the recording material, the above-mentioned components can prevent the silicone oil from staying in the recording sheet.

Furthermore, the image transfer material of the present invention comprise at least on the surface thereof at least one component selected from the group consisting of an oxidizing agent, a reducing agent, an esterification agent, a coupling agent, a gelling agent, and a polymerization initiator.

These components are capable of reacting with the liquid recording material of the present invention, so that significantly highly improved image fixing performance can be attained when the image transfer material of the present invention and the liquid recording material of the present invention are used in combination.

The image developed by using the above-mentioned liquid recording material of the present invention can be fixed on the above-mentioned image transfer material of the present invention with the application of corona charge thereto as an external stimulus. As the external stimulus, not only the corona charge, but also light such as UV and flash light, and heat from a heat roller or hot air can be employed. In this image fixing method, oxidation polymerization is promoted, so that the image fixing performance can be improved.

As mentioned above, the reactive silicone material for use in the present invention may comprise such a compound that contains in the molecule thereof at least one group selected from the group consisting of isocyanate group, Si—H group, vinyl group, amino group, hydroxyl group, epoxy group, and methacryloxy group. Such reactive silicone materials and reactive silicone compounds are commercially available. TABLE 1 shows representative examples of such reactive silicone materials and compounds.

TABLE 1

(1)

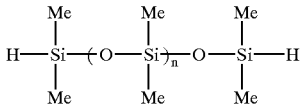

[FM1111, 1121 and 1125 (Trademarks), made by Chisso Corporation]

(2)

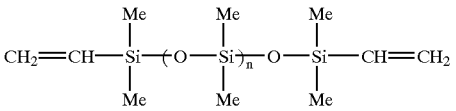

[FM2231, 2241 and 2242 (Trademarks), made by Chisso Corporation]

(3)

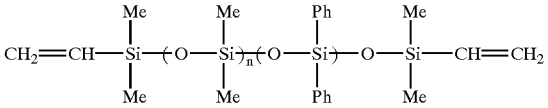

[FP2231, 2241 and 2242 (Trademarks), made by Chisso Corporation]

(4)

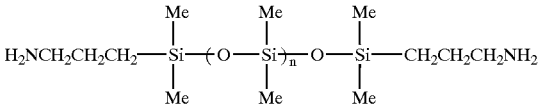

[FM3311, 3321 and 3325 (Trademarks), made by Chisso Corporation]

(5)

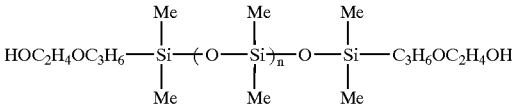

[FM4411, 4421 and 4425 (Trademarks), made by Chisso Corporation]

(6)

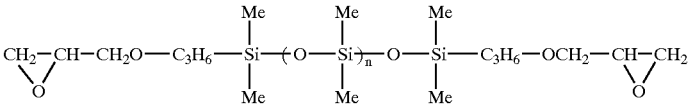

[FM5511, 5521 and 5525 (Trademarks), made by Chisso Corporation]

(7)

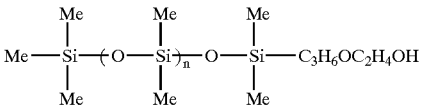

[FM0411, 0421 and 0425 (Trademarks), made by Chisso Corporation]

(8)

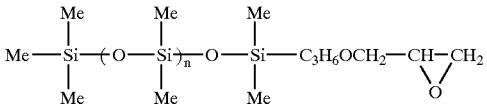

[FM0511, 0521 and 0525 (Trademarks), made by Chisso Corporation]

TABLE 1-continued (9)

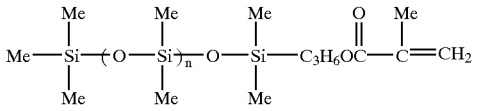

[FM0711, 0721 and 0725 (Trademarks), made by Chisso Corporation]

In addition, the following reactive silicone materials which are commercially available from Shin-Etsu Chemical Co., Ltd., can be employed in the present invention:

amino-modified silicone compounds such as "X-22-161A", "KF867" and "KF865" (Trademarks), epoxy-modified silicone compounds such as "X-22-163B" and "X-22-169AS" (Trademarks), carboxy-modified silicone compound such as "X-22-162C" (Trademark), Carbitol-modified silicone compound such as "KF-6002" (Trademark), methacryl-modified silicone compounds such as "X-22-164C" and "X-22-5002" (Trademarks), mercapto-modified silicone compound such as "X-22-980" (Trademark), phenol-modified silicone compound such as "X-22-165B" (Trademark), one-side terminal reactive silicone materials such as "X-22-174DX" and "X-22-174D" ™, and hetero-functional-group-modified silicone compounds such as "KF862", "X-22-3667", "X-22-3959A", "KF99" and "FM-1125" ™.

Examples of silicone RTV (Room Temperature Vulcanizing) silicone rubbers are one-pack type RTV rubbers such as "KE41", "KE42", "KE40RTV", "KE3491" and "KE3492" ™ made by Shin-Etsu Chemical Co., Ltd., and two-pack type RTV silicone rubbers such as "KE119", "KE108" and "KE110 Gel" ™ made by Shin-Etsu Chemical Co., Ltd.

These silicone rubbers are used with the viscosity and physical properties thereof being adjusted so as to make them suitable for use in toner or ink or the like by changing the amount of a curing agent or a silicone oil for dilution to be added thereto.

In the present invention, the reactive silicone material can be employed in the carrier liquid. The recording performance of the liquid recording material of the present invention can be further improved by use of a polymerizable vinyl monomer in the combination with the reactive silicone material in the carrier liquid.

More specifically, it is preferable that the weight ratio of the polymerizable vinyl monomer/the reactive silicone material be in the range of 1/0.01 to 1/9, more preferably, in the range of 1/0.1 to 1/7. When the amount of the reactive silicone material is less than 0.01 in terms of the above-mentioned weight ratio, the dispersibility or solubility of the polymerized resin in the silicone solvent is reduced, while when the amount of the reactive silicone material is more than 9 in terms of the above-mentioned weight ratio, the adhesive force of the polymerized resin is reduced. In accordance with the characteristics required, the combination of the polymerizable vinyl monomer and the reactive silicone material in terms of their kinds can be changed.

In the present invention, a carrier liquid comprising the reactive silicone material and a silicone oil which is mixed with the reactive silicone material can also be employed. More specifically, a poly-dialkylsiloxane and a cyclic poly-dialkylsiloxane with a kinematic viscosity of 0.01 to 1,000,000 centistokes, preferably, with a kinematic viscosity of 1 to 10,000 centistokes at 25° C., are preferable.

Examples of the above-mentioned polymerizable vinyl monomer are vinyl monomers for homopolymerization, and monomers for copolymerization in the presence of a cross-linking agent and other monomers.

Specific examples of the vinyl monomers are (meth) acrylic acid, maleic acid, maleic anhydride, itaconic acid, itaconic anhydride, fumaric acid, cinnamic acid, crotonic acid, vinylbenzoic acid, 2-methacryloxyethyl succinic acid, 2-methacryloxyethyl maleic acid, 2-methacryloxyethyl hexahydrophthalic acid, 2-methacryloxyethyl trimellitic acid, vinylsulfonic acid, allyl sulfonic acid, styrene sulfonic acid, 2-sulfoethyl methacrylate, 2-acrylamide-2-methylpropanesulfonic acid, 3-chloroamidephosxipropyl methacrylate, 2-methacryloxyethyl acid phosphate, hydroxystyrene, glycidyl methacrylate, 2-hydroxyethyl (meth)acrylate, 2,3-dihydroxypropyl (meth)acrylate, 4-hydroxybutyl (meth)acrylate, 2-hydroxy-3-propylmethacrylate, 2-chloroethyl (meth)acrylate, 2,3-dibromopropyl (meth)acrylate, (meth)acrylonitrile, vinyl chloride, isobutyl-2-cyanoacrylate, 2-cyanoethylacrylate, ethyl-2-cyanoacrylate, methacrylacetone, tetrahydrofurfuryl methacrylate, trifluoroethylmethacrylate, p-nitrostyrene, vinylbenzene, ethyleneglycol di(meth)acrylate, diethyleneglycol di(meth)acrylate, triethyleneglycol tri(meth)acrylate, butanediol di(meth)acrylate, 1,6-hexanediol di(meth) acrylate, trimethylolpropane tri(meth)acrylate, tetramethylolmethane tri(meth)acrylate, tetramethylolmethane tetra (meth)acrylate, dipropylene-glycol di(meth)acrylate, trimethylolhexane tri-(meth)acrylate, pentaerythritol tetra (meth)acrylate, 1,3-dibutylene glycol di(meth)acrylate, trimethylolethane tri(meth)acrylate, N-methylaminoethyl (meth)acrylate, N-ethylaminoethyl (meth)acrylate, N,N-dimethylaminoethyl (meth)acrylate N,N-diethylaminoethyl (meth)acrylate, N,N-dibutylaminoethyl acrylate, N-phenylaminoethyl methacrylate, N,N-diphenylaminoethyl methacrylate, aminostyrene, dimethylaminostyrene, N-methylaminoethyl-styrene, dimethylaminoethoxystyrene, diphenylaminoethyl-styrene, N-phenylaminoethylstyrene, vinylpyrrolidone, 2-N-piperidylethyl (meth)acrylate, 2-vinylpyridine, 4-vinylpyridine, 2-vinyl-6-methylpyridine, acrylamide, methacrylamide, N,N-dimethyl methacrylamide, N,N-dibutyl methacrylamide, 2-ethylhexyl (meth)acrylate, octyl (meth)acrylate, nonyl (meth)acrylate, decyl (meth)acrylate, lauryl (meth)acrylate, stearyl (meth)acrylate, vinyl laurate, lauryl methacrylamide, stearyl methacrylamide, methoxyethyl (meth)acrylate, ethoxyethyl (meth)acrylate, butoxyethyl (meth)acrylate, methyl (meth)acrylate, ethyl (meth) acrylate, butyl (meth)acrylate, hexyl (meth)acrylate, cyclohexyl (meth)acrylate, benzyl (meth)acrylate, phenyl (meth)acrylate, styrene, vinyltoluene, and vinyl acetate.

It is preferable that the amount of these polymerizable monomers be employed in an amount of 0.1 to 50 parts by weight to 100 parts by weight of the reactive silicone material.

In the present invention, the following compounds can be employed as a dispersing agent or a charge control agent: metal titanate coupling agents such as tetra-n-butoxy titanium, tetraisopropoxy titanium, isopropyl-triisostearoyl titanate, bis(dioctylpyrophosphate)-ethylene titanate, isopropyl tris(dioctylpyrophosphate) titanate, isopropyl tri (dioctylphosphate) titanate, isopropyl tridodecylbenzene sulfonyl titanate, diisostearoylethylene titanate, isopropyltrioctyl titanate, bis(dioctylpyrophosphate)oxyacetate titanate, isopropyl tricumylphenyl titanate, and dicumylphenyloxyacetate titanate. Those metal coupling agents may be used alone or in combination.

In addition, manganese octylate, cobalt, nickel, calcium, manganese naphthenate can be employed.

Furthermore, when necessary, for example, the following charge control agents can also be added to the liquid recording material of the present invention: lecithin, petroleum calcium sulfonate, sodium dioctyl sulfonate, alkylalanine, calcium alkylnaphthalene-sulfonate, and di-2-ethylhexyl sodium sulfosuccinate.

Particularly good and suitable coloring agents for use in the present invention are a disazo yellow pigment, a carmine pigment, a quinacridone pigment and a phthalocyanine pigment. These pigments also have good stability. However, the reason why these pigments have such a good stability has not yet been thoroughly analyzed, but it is considered that these pigments contain appropriate polar groups in the molecules thereof, so that the charge control agents and resins can be properly adsorbed by the pigments and therefore no polarity biasing is caused in the toner particles contained in the liquid recording material of the present invention by discharge current applied thereto.

Specific examples of each of the above-mentioned pigments are as follows:

Examples of the disazo yellow pigment include Pigment Yellow 12, Pigment Yellow 13, Pigment Yellow 14, Pigment Yellow 17, Pigment Yellow 55, Pigment Yellow 81, and Pigment Yellow 83.

Examples of the carmine pigment of magenta include Pigment Red 5, Pigment Red 57, Pigment Red 60, Pigment Red 114, Pigment Red 146, and Pigment Red 185.

Examples of the quinacridone pigment include Pigment Red 112 and Pigment Red 209.

Examples of the phthalocyanine pigment include Pigment Blue 15:1 (α-phthalocyanine), Pigment Blue 15:3, Pigment Blue 15:4, Pigment Blue 15:6, and Pigment Blue 16.

Furthermore, the following pigments represented by formulae (1) to (3) are particularly preferable for use in the present invention:

(1)

(Disazo yellow pigments)

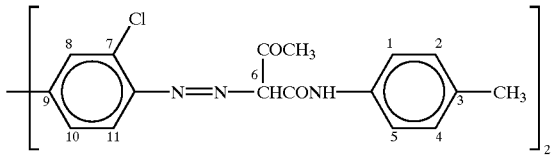

Compound No. 1-1:

—$OCH_3$ at position 1 in formula (1)

Compound No. 1-2:

—$OCH_3$ at positions 1 and 7 in formula (1)

Compound No. 1-3:

—Cl at position 10 in formula (1)

Compound No. 1-4:

—$C_2H_5$ at position 3 in formula (1)

Compound No. 1-5:

—$C_4H_9$ at position 3 in formula (1)

Compound No. 1-6:

—$COC_2H_5$ at position 6 in formula (1)

Compound No. 1-7:

—$COC_4H_9$ at position 6 in formula (1), and

Compound No. 1-8:

—COOH at position 5 in formula (1)

(2)

(Carmine pigments)

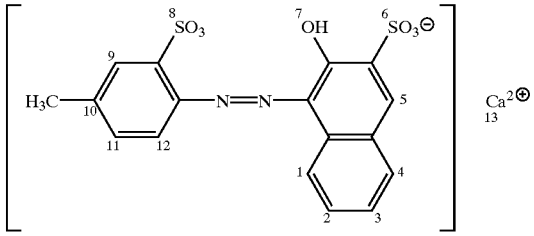

Compound No. 2-1:

—OH at position 2 and position 11 in formula (2)

Compound No. 2-2:

—COOH at position 2 in formula (2)

Compound No. 2-3:

—$CH_3$ at position 1 in formula (2)

Compound No. 2-4:

—$OCH_3$ at position 10, and

—OH at position 2 in formula (2)

Compound No. 2-5:

—OH at position 12, and —$CH_3$ at position 4 in formula (2)

Compound No. 2-6:

the same as Compound No. 2-1, provided that $Ba^{2\oplus}$ is at position 13 in formula (2)

Compound No. 2-7:

the same as Compound No. 2-2, provided that $Zn^{2\oplus}$ is at position 13 in formula (2)

Compound No. 2-8:

the same as Compound No. 2-4, provided that $Ba^{2\oplus}$ is at position 13 in formula (2)

(Phthalocyanine pigments) (3)

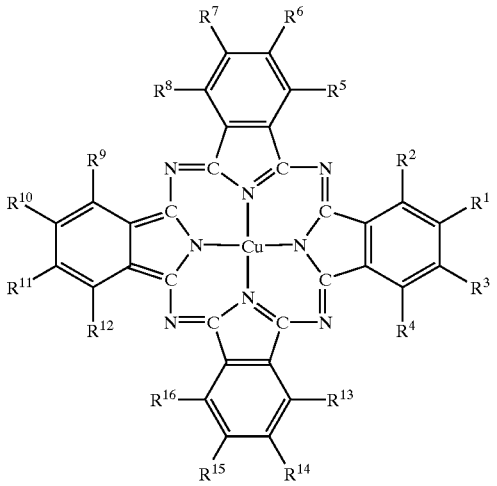

Compound No. 3-1:

$R^1$ and $R^{14}$: —Cl $R^2$ to $R^{13}$, $R^{15}$, and $R^{16}$: —H in formula (3)

Compound No. 3-2:

$R^1$ and $R^{14}$: —Br $R^2$ to $R^{13}$ $R^{15}$, and $R^{16}$: —H in formula (3)

Compound No. 3-3:

$R^1$, $R^6$, $R^{12}$, and $R^{14}$:—Cl $R^2$ to $R^5$, $R^7$ to $R^{11}$, $R^{13}$, $R^{15}$, and $R^{16}$: —H in formula (3)

Compound No. 3-4:

the same as Compound No. 3-1, provided that the metal Cu is replaced by Zn in formula (3)

Compound No. 3-5:

the same as Compound No. 3-2, provided that the metal Cu is replaced by Ca in formula (3)

Compound No. 3-6:

the same as Compound No. 3-3, provided that the metal Cu is replaced by Ba in formula (3)

Compound No. 3-7:

$R^1$, $R^6$, $R^{10}$, and $R^{14}$: —$OCH_3$ $R^2$ to $R^6$, $R^7$ to $R^9$, $R^{11}$ to $R^{13}$, $R^{15}$ and $R^{16}$: —H in formula (3)

Compound No. 3-8:

$R^1$, $R^6$, $R^{10}$, and $R^{14}$: —$OC_2H_5$

R to $R^1$, $R^1$ to $R^9$, $R^{11}$ to $R^{13}$, $R^{15}$ and $R^{16}$: —H in formula (3)

The liquid recording material of the present invention, which also may be referred to as a liquid developer, comprises the carrier liquid, the coloring agent, the resin, and the reactive silicone material, and is prepared, with the addition of a charge control agent thereto when necessary, in such a manner that toner particles with an average particle size of 20 $\mu$m or less, preferably in the range of 0.2 to 10 $\mu$m, are dispersed therein in a dispersion mixer such as a keddy mill, a bead mill, an attritor, a ball mill, a roll mill or a three-roll mill.

The reactive silicone material for use in the present invention is capable of highly dispersing pigments therein, so that even when the liquid recording material with toner particles having a reduced particle size is allowed to stand for an extended period of time, the toner particles are difficult to sediment. Furthermore, by use of the reactive silicone material, it is possible to provide recording materials such as an electrophotographic developer capable of producing excellent image density and color characteristics, in particular, high glossiness, ink jet printing inks, and printing inks. Furthermore, by use of the reactive silicone material in dyes, dyes with high glossiness, water resistance and solvent resistance, can be obtained.

In the present invention, the recording material comprising the reactive silicone material can be subjected to an external stimulus such as light stimulus, heat stimulus or electric stimulus (which is referred to as a method A), or can be allowed to react with a functional material such as an oxidizing agent, a reducing agent, an estrification agent, a coupling agent, a polymerization initiator, crosslinking agent, or a gelling agent (which is referred to as a method B), or can be subjected to the treatment in which the method A and the method B are combined, whereby the reactive silicone material can be polymerized.

Alternatively, a sheet of paper or the cellulose of the paper is coated with the above-mentioned functional material employed in the method B, and images are printed on the paper, using the recording material comprising the reactive silicone material of the present invention, which may be in the form of an electrophotographic developer, or in the form of an ink jet printing ink or a printing ink, and the printed images are fixed to the paper, using the chemical reaction or physical adsorption of the reactive silicone material with the paper.

The liquid recording material of the present invention, which may be in the form of a liquid electrophotographic developer, can be produced by kneading and dispersing the carrier liquid, the coloring agent, the resin, when necessary, with the addition of conventional additives, in the presence of the reactive silicone material, which may serve as the carrier liquid as well, in a mixer such as a ball mill or an attritor.

It is preferable that the amount of the resin be in the range of 0.01 to 10 parts by weight to 1 part by weight of the coloring agent.

Specific examples of the coloring agent for use in the present invention are:

carbon black such as "MA-100", "#44" and "#33" ™ made by Mitsubishi Chemical Corporation, "Raben 1250" and "Raben 1020" ™ made by Columbian Carbon Ltd., and "Black Pearl L" and "Black Pearl 1100" ™ made by Cabot Corporation, "Printex 55" and "Special Black 4" ™ made by Degussa Japan Co., Ltd.; and organic pigments such as insoluble azo pigments, soluble azo pigments, phthalo-cyanine pigments, isoindolinone higher pigments, quinacridone higher pigments, and perinone•perylene higher pigments.

Specific examples of the resin for use in the present invention are ethyl cellulose, linseed-oil-modified alkyd resin, acrylic or methacrylic ester resin, polystyrene, silcone-acryl copolymer, silicone resin, silicone-(meth)acryl copolymer, block polymer or graft polymer, polyolefin copolymer, poly(vinyl chloride) resin, chlorinated polypropylene, polyamide resin, coumarone-indene resin, rosin-modified resin, and alkylphenol-modified xylene resin.

It is preferable that the reactive silicone material used as the carrier liquid have a viscosity of 0.5 to 10,000 CS, more preferably a viscosity of 5 to 5000 CS, in terms of the physical properties thereof.

EXAMPLE 1

A mixture of the following components was dispersed in an attritor for 2 hours:

| | Parts by Weight |
|---|---|
| Carbon black (Trademark "#44", made by Mitsubishi Chemical Corporation) | 100 |
| Lauryl methacrylate/methyl methacrylate (60/40) copolymer | 50 |
| Reactive silicone material (Trademark "X22-5002", made by Shin-Etsu Chemical Co., Ltd.) | 500 |

Thus, a liquid recording material No. 1 of the present invention, which can be used as an electrophotographic liquid developer, with a toner particle size of 1.26 μm, was obtained.

By use of the liquid recording material No. 1, images were formed, using a commercially available electrophotographic copying machine ™ "RICOPY FT-400i", made by Ricoh Co., Ltd.). As a result, excellent copy images with an image density of 1.24, a background density of 0.01, and a resolution of 6.3 lines/mm, were obtained. The image fixing ratio of the images measured by the clock meter method was 71%.

EXAMPLE 2

100 parts by weight of carbon black ™ "Mitsubishi #MA-11", made by Mitsubishi Chemical Corporation) and 500 parts by weight of rosin-modified maleic acid resin were kneaded at 150° C. in a kneader, whereby a coloring agent A was obtained.

To 100 parts by weight of the thus obtained coloring agent A, 0.5 parts by weight of cobalt naphthenate and 500 parts by weight of a reactive silicone "FM-1111" ™ made by Chisso Corporation were added. The mixture was dispersed in an attritor for 3 hours, whereby a liquid recording material No. 2 of the present invention, in the form of a liquid toner with an average toner particle size of 1.52 μm, was obtained.

By use of the liquid recording material No. 2, images were formed, using a commercially available electrophotographic copying machine ™ "RICOPY FT-400i", made by Ricoh Co., Ltd.). As a result, excellent copy images with an image density of 1.26, a background density of 0.01, a resolution of 6.3 lines/mm, and a glossiness of 26% were obtained. The image fixing ratio of the images was 80%.

For comparison, the same procedure of producing the liquid recording material No. 2 as mentioned above was repeated except that the reactive silicone "FM-1111" ™ employed in the above was replaced by a non-reactive silicone "KF96-50CS" ™, made by Shin-Etsu Chemical Co., Ltd., whereby a comparative liquid recording material was prepared. The average toner particle size of the comparative liquid recording material was 13.50 μm.

By use of the comparative liquid recording material, images were formed, using the same commercially available electrophotographic copying machine (™ "RICOPY FT-400i", made by Ricoh Co., Ltd.) as mentioned above. As a result, copy images with an image density of 0.66, a resolution of 4.3 lines/mm, and a glossiness of 4.1%, which were conspicuously inferior to the images obtained by the liquid recording material No. 2 of the present invention, were obtained. It is considered that this was because the average toner particle size of the comparative liquid recording material which was produced, using the non-reactive silicone "KF96-50CS" ™, was as large as 13.50 μm and therefore the charging of the toner particles was not uniform.

EXAMPLE 3

The same procedure of producing the liquid recording material No. 1 as in Example 1 was repeated except that the reactive silicone material (™ "X22-5002", made by Shin-Etsu Chemical Co., Ltd.) employed in Example 1 was replaced by a reactive silicone "KF99" ™, made by Shin-Etsu Chemical Co., Ltd. and that 5.0 parts by weight of a silane coupling agent were added thereto, whereby a liquid recording material No. 3 of the present invention was produced. The average toner particle size of the liquid recording material No. 3 was 0.29 μm.

By use of the liquid recording material No. 3, images were formed, using the same commercially available electrophotographic copying machine (™ "RICOPY FT-400i", made by Ricoh Co., Ltd.) as mentioned above. As a result, copy images with an image density of 1.23, a background density of 0.01, and a resolution of 6.3 lines/mm were obtained. The image fixing ratio of the images was 86%.

EXAMPLE 4

The same procedure of producing the liquid recording material No. 1 as in Example 1 was repeated except that the reactive silicone material (™ "X22-5002", made by Shin-Etsu Chemical Co., Ltd.) employed in Example 1 was replaced by a reactive silicone "FP2231" ™, made by Chisso Corporation, whereby a liquid recording material No. 4 of the present invention was produced. The average toner particle size of the liquid recording material No. 4 was 0.32 μm.

By use of the liquid recording material No. 4, images were formed, using the same commercially available electrophotographic copying machine (™ "RICOPY FT-400i", made by Ricoh Co., Ltd.) as mentioned above. As a result, copy images with an image density of 1.26, a background density of 0.01, and a resolution of 7.2 lines/mm were obtained. The image fixing ratio of the images was 76%.

EXAMPLE 5

The same procedure of producing the liquid recording material No. 2 as in Example 2 was repeated except that the reactive silicone "FM-1111" ™made by Chisso Corporation employed in Example 2 was replaced by a reactive silicone "FP2231" ™, made by Chisso Corporation, whereby a liquid recording material No. 5 of the present invention was produced. The average toner particle size of the liquid recording material No. 5 was 0.43 μm.

By use of the liquid recording material No. 5, images were formed, using the same commercially available electrophotographic copying machine (™ "RICOPY FT-400i", made by Ricoh Co., Ltd.) as mentioned above. As a result, copy images with an image density of 1.31, a background density of 0.01, and a resolution of 6.3 lines/mm were obtained. The image fixing ratio of the images was 74%.

EXAMPLE 6

The same procedure of producing the liquid recording material No. 2 as in Example 2 was repeated except that the reactive silicone "FM-1111" ™made by Chisso Corporation employed in Example 2 was replaced by a reactive silicone "FM3311" ™, made by Chisso Corporation, whereby a liquid recording material No. 6 of the present invention was produced. The average toner particle size of the liquid recording material No. 6 was 0.21 μm.

By use of the liquid recording material No. 6, images were formed, using the same commercially available electrophotographic copying machine (™ "RICOPY FT-400i", made by Ricoh Co., Ltd.) as mentioned above. As a result, copy images with an image density of 1.33, a background density of 0.01, and a resolution of 6.3 lines/mm were obtained. The image fixing ratio of the images was 77%.

EXAMPLE 7

The same procedure of producing the liquid recording material No. 2 as in Example 2 was repeated except that the reactive silicone "FM-1111" ™made by Chisso Corporation employed in Example 2 was replaced by a reactive silicone "FM4421" ™, made by Chisso Corporation, whereby a liquid recording material No. 7 of the present invention was produced. The average toner particle size of the liquid recording material No. 7 was 0.26 μm.

By use of-the liquid recording material No. 7, images were formed, using the same commercially available electrophotographic copying machine (™ "RICOPY FT-400i", made by Ricoh Co., Ltd.) as mentioned above. As a result, copy images with an image density of-1.30, a background density of 0.01, and a resolution of 7.2 lines/mm were obtained. The image fixing ratio of the images was 76%.

EXAMPLE 8

The same procedure of producing the liquid recording material No. 1 as in Example 1 was repeated except that the reactive silicone material (™ "X22-5002", made by Shin-Etsu Chemical Co., Ltd.) employed in Example 1 was replaced by a reactive silicone "FM0511" ™, made by Chisso Corporation, whereby a liquid recording material No. 8 of the present invention was produced. The average toner particle size of the liquid recording material No. 8 was 0.38 μm.

By use of the liquid recording material No. 8, images were formed, using the same commercially available electrophotographic copying machine (™ "RICOPY FT-400i", made by Ricoh Co., Ltd.) as mentioned above. As a result, copy images with an image density of 1.36, a background density of. 0.01, and a resolution of 7.2 lines/mm were obtained. The image fixing ratio of the images was 76%.

EXAMPLE 9

The same procedure of producing the liquid recording material No. 3 as in Example 3 was repeated except 100 parts by weight of lauryl methacrylate were added to the formulation for the liquid recording material No. 3, whereby a liquid recording material No. 9 of the present invention was produced. The average toner particle size of the liquid recording material No. 9 was 0.58 μm.

By use of the liquid recording material No. 9, images were formed, using the same commercially available electrophotographic copying machine (™ "RICOPY FT-400i", made by Ricoh Co., Ltd.) as mentioned above. As a result, copy images with an image density of 1.25, a background density of 0.02, and a resolution of 6.3 lines/mm were obtained. The image fixing ratio of the images was 82%.

EXAMPLE 10

The same procedure of producing the liquid recording material No. 4 as in Example 4 was repeated except that the coloring agent, namely, carbon black (™ "#44" made by Mitsubishi Chemical Corporation), employed in Example 4 was replaced by Carmine 6B, whereby a liquid recording material No. 10 of the present invention was produced. The average toner particle size of the liquid recording material No. 10 was 0.19 μm.

By use of the liquid recording material No. 10, images were formed, using the same commercially available electrophotographic copying machine (™ "RICOPY FT-400i", made by Ricoh Co., Ltd.) as mentioned above. As a result, copy images with an image density of 1.30, a background density of 0.01, and a resolution of 6.3 lines/mm were obtained. The image fixing ratio of the images was 78%.

EXAMPLE 11

The same procedure of producing the liquid recording material No. 5 as in Example 5 was repeated except that 30 wt. % of the reactive silicone "FP2231" ™, made by Chisso Corporation employed in Example 5 was replaced by "Isopar H" ™, made by Exxon Chemical Japan Ltd., whereby a liquid recording material No. 11 of the present invention was produced. The average toner particle size of the liquid recording material No. 11 was 0.63 μm.

By use of the liquid recording material No. 11, images were formed, using the same commercially available electrophotographic copying machine (™ "RICOPY FT-400i", made by Ricoh Co., Ltd.) as mentioned above. As a result, copy images with an image density of 1.18, a background density of 0.03, and a resolution of 5.6 lines/mm were obtained. The image fixing ratio of the images was 75%.

EXAMPLE 12

The same procedure of producing the liquid recording material No. 5 as in Example 5 was repeated except that 30 wt. % of the reactive silicone "FP2231" ™, made by Chisso Corporation employed in Example 5 was replaced by soybean oil, whereby a liquid recording material No. 12 of the present invention was produced. The average toner particle size of the liquid recording material No. 12 was 0.88 μm.

By use of the liquid recording material No. 12, images were formed, using the same commercially available electrophotographic copying machine (™ "RICOPY FT-400i", made by Ricoh Co., Ltd.) as mentioned above. As a result, copy images with an image density of 1.24, a background density of 0.02, and a resolution of 5.6 lines/mm were obtained. The image fixing ratio of the images was 71%.

EXAMPLE 13

The same procedure of producing the liquid recording material No. 5 as in Example 5 was repeated except that 30 wt. % of the reactive silicone "FP2231" ™, made by Chisso Corporation employed in Example 5 was replaced by isopropyl myristate, whereby a liquid recording material No. 13 of the present invention was produced. The average toner particle size of the liquid recording material No. 13 was 0.69 μm.

By use of the liquid recording material No. 13, images were formed, using the same commercially available electrophotographic copying machine (™ "RICOPY FT-400i", made by Ricoh Co., Ltd.) as mentioned above. As a result, copy images with an image density of 1.26, a background density of 0.02, and a resolution of 5.6 lines/mm were obtained. The image fixing ratio of the images was 70%.

EXAMPLE 14

The same procedure of producing the liquid recording material No. 2 as in Example 2 was repeated except that 20 wt. % of the reactive silicone "FM-1111" ™made by Chisso Corporation employed in Example 2 was replaced by a non-reactive silicone oil "KF96-100CS" ™, made by Shin-Etsu Chemical Co., Ltd., whereby a liquid recording material No. 14 of the present invention was produced. The average toner particle size of the liquid recording material No. 14 was 2.43 μm.

By use of the liquid recording material No. 14, images were formed, using the same commercially available electrophotographic copying machine (™ "RICOPY FT-400i", made by Ricoh Co., Ltd.) as mentioned above. As a result, copy images with an image density of 1.26, a background density of 0.01, and a resolution of 6.3 lines/mm were obtained. The image fixing ratio of the images was 62%.

EXAMPLE 15

The same procedure of producing the liquid recording material No. 2 as in Example 2 was repeated except 13 parts by weight of a polymerization initiator (™"KAYA ESTER-O") were added to the formulation for the liquid recording material No. 2, whereby a liquid recording material No. 15 of the present invention was produced. The average toner particle size of the liquid recording material No. 15 was 0.38 μm.

By use of the liquid recording material No. 15, images were formed, using the same commercially available electrophotographic copying machine (™ "RICOPY FT-400i", made by Ricoh Co., Ltd.) as mentioned above. As a result, copy images with an image density of 1.28, a background density of 0.01, and a resolution of 6.3 lines/mm were obtained. The image fixing ratio of the images was 88%.

EXAMPLE 16

The same procedure of producing the liquid recording material No. 13 as in Example 13 was repeated except 3 parts by weight of calcium oleate were added to the formulation of the liquid recording material No. 13, whereby a liquid recording material No. 16 of the present invention was produced. The average toner particle size of the liquid recording material No. 16 was 0.82 μm.

By use of the liquid recording material No. 16, images were formed, using the same commercially available electrophotographic copying machine (™ "RICOPY FT-400I", made by Ricoh Co., Ltd.) as mentioned above. As a result, copy images with an image density of 1.30, a background density of 0.01, and a resolution of 5.3 lines/mm were obtained. The image fixing ratio of the images was 76%.

EXAMPLE 17

The same procedure of producing the liquid recording material No. 12 as in Example 12 was repeated except 5 parts by weight of cobalt naphthenate were added to the formulation for the liquid recording material No. 12, whereby a liquid recording material No. 17 of the present invention was produced. The average toner particle size of the liquid recording material No. 17 was 0.64 μm.

By use of the liquid recording material No. 17, images were formed, using the same commercially available electrophotographic copying machine (™ "RICOPY FT-400i", made by Ricoh Co., Ltd.) as mentioned above. As a result, copy images with an image density of 1.38, a background density of 0.01, and a resolution of 6.3 lines/mm were obtained. The image fixing ratio of the images was 81%.

EXAMPLE 18

The same procedure of producing the liquid recording material No. 5 as in Example 5 was repeated except that 30 wt. % of the reactive silicone "FP2231" ™, made by Chisso Corporation employed in Example 5 was replaced by tung oil and that 5 parts by weight of cobalt naphthenate were added to this formulation, whereby a liquid recording material No. 18 of the present invention was produced. The average toner particle size of the liquid recording material No. 18 was 0.58 μm.

By use of the liquid recording material No. 18, images were formed, using the same commercially available electrophotographic copying machine (™ "RICOPY FT-400i", made by Ricoh Co., Ltd.) as mentioned above. As a result, copy images with an image density of 1.29, a background density of 0.02, and a resolution of 6.3 lines/mm were obtained. The image fixing ratio of the images was 85%.

EXAMPLE 19

The same procedure of producing the liquid recording material No. 18 as in Example 18 was repeated except that the tung oil employed in Example 18 was replaced by a silicone RTV rubber "KE110 Gel" ™containing 0.5 wt. % of a curing agent made by Shin-Etsu Chemical Co., Ltd., whereby a liquid recording material No. 19 of the present invention was produced. The average toner particle size of the liquid recording material No. 19 was 0.53 μm.

By use of the liquid recording material No. 19, images were formed, using the same commercially available electrophotographic copying machine (™ "RICOPY FT-400i", made by Ricoh Co., Ltd.) as mentioned above. As a result, copy images with an image density of 1.32, a background density of 0.01, and a resolution of 7.2 lines/mm were obtained. The image fixing ratio of the images was 88%.

EXAMPLE 20

The same procedure of producing the liquid recording material No. 1 as in Example 1 was repeated except that the lauryl methacrylate/methyl methacrylate (60/40) copolymer employed in Example 1 was replaced by a silicone rubber "KE108" ™made by Shin-Etsu Chemical Co., Ltd., whereby a liquid recording material No. 20 of the present invention was produced. The average toner particle size of the liquid recording material No. 20 was 0.38 μm.

By use of the liquid recording material No. 20, images were formed, using the same commercially available electrophotographic copying machine (™ "RICOPY FT-400i", made by Ricoh Co., Ltd.) as mentioned above. As a result, copy images with an image density of 1.33, a background density of 0.01, and a resolution of 6.3 lines/mm were obtained. The image fixing ratio of the images was 90%.

TABLE 2

| Ex. No. | (1) Coloring Agent (2) Resin (3) Reactive Silicone Material (4) Additional Component | Toner Particle Size (μm) | Back-ground Density | Image Density | Resolu-tion (lines/mm) | Image Fixing Ratio (%) |
|---|---|---|---|---|---|---|
| 1 | (1) Carbon Black (2) Lauryl methacrylate/Methyl methacrylate (60/40) copolymer (3) "X22-5002" | 1.26 | 0.01 | 1.24 | 6.3 | 71 |
| 2 | (1) Carbon Black (2) Rosin-modified maleic acid resin (3) "FM 1111" | 1.52 | 0.01 | 1.26 | 6.3 | 80 |
| 3 | (1) Carbon Black (2) Lauryl methacrylate/Methyl methacrylate (60/40) copolymer (3) "KF99" + Silane coupling agent | 0.29 | 0.01 | 1.23 | 6.3 | 86 |
| 4 | (1) Carbon Black (2) Lauryl methacrylate/Methyl methacrylate (60/40) copolymer (3) "FP2231" | 0.32 | 0.01 | 1.26 | 7.2 | 76 |
| 5 | (1) Carbon Black (2) Rosin-modified maleic acid resin (3) "FP2231" | 0.43 | 0.01 | 1.31 | 6.3 | 74 |
| 6 | (1) Carbon Black (2) Rosin-modified maleic acid resin (3) "FM3311" | 0.21 | 0.01 | 1.33 | 6.3 | 77 |
| 7 | (1) Carbon Black (2) Rosin-modified maleic acid resin (3) "FM4421" | 0.26 | 0.01 | 1.30 | 7.2 | 76 |
| 8 | (1) Carbon Black (2) Lauryl methacrylate/Methyl methacrylate (60/40) copolymer (3) "FM0511" | 0.38 | 0.01 | 1.36 | 7.2 | 76 |
| 9 | (1) Carbon Black (2) Lauryl methacrylate/Methyl methacrylate (60/40) copolymer + Lauryl methacrylate (3) "KF99" + Silane coupling agent | 0.58 | 0.02 | 1.25 | 6.3 | 82 |
| 10 | (1) Carmine 6B (2) Lauryl methacrylate/Methyl methacrylate (60/40) copolymer (3) "FP2231" | 0.19 | 0.01 | 1.30 | 6.3 | 78 |
| 11 | (1) Carbon Black (2) Rosin-modified maleic acid resin (3) "FP2231" (70%) + "Isopar H" (30%) | 0.63 | 0.03 | 1.18 | 5.6 | 75 |
| 12 | (1) Carbon Black (2) Rosin-modified maleic acid resin (3) "FP2231" (70%) + Soybean Oil (30%) | 0.88 | 0.02 | 1.24 | 5.6 | 71 |
| 13 | (1) Carbon Black (2) Rosin-modified maleic acid resin (3) "FP2231" (70%) + Isopropyl myristate (30%) | 0.69 | 0.02 | 1.26 | 5.6 | 70 |
| 14 | (1) Carbon Black (2) Rosin-modified maleic acid resin (3) "FM-1111" (80%) + "KF96-100CS" (20%) | 2.43 | 0.01 | 1.26 | 6.3 | 62 |
| 15 | (1) Carbon Black (2) Rosin-modified maleic acid resin | 0.38 | 0.01 | 1.28 | 6.3 | 88 |

TABLE 2-continued

| Ex. No. | (1) Coloring Agent<br>(2) Resin<br>(3) Reactive Silicone Material<br>(4) Additional Component | Toner Particle Size (μm) | Back-ground Density | Image Density | Resolu-tion (lines/mm) | Image Fixing Ratio (%) |
|---|---|---|---|---|---|---|
| | (3) "FM-1111" + "KAYA ESTER-O" | | | | | |
| 16 | (1) Carbon Black<br>(2) Rosin-modified maleic acid resin<br>(3) "FP2231" (70%) + Isopropyl myristate (30%)<br>(4) Calcium oleate | 0.82 | 0.01 | 1.30 | 5.3 | 76 |
| 17 | (1) Carbon Black<br>(2) Rosin-modified maleic acid resin<br>(3) "FP2231" (70%) + Soybean Oil (30%)<br>(4) Cobalt naphthenate | 0.64 | 0.01 | 1.38 | 6.3 | 81 |
| 18 | (1) Carbon Black<br>(2) Rosin-modified maleic acid resin<br>(3) "FP2231" (70%) + Tung Oil (30%)<br>(4) Cobalt naphthenate | 0.58 | 0.02 | 1.29 | 6.3 | 85 |
| 19 | (1) Carbon Black<br>(2) Rosin-modified maleic acid resin<br>(3) "FP2231" (70%) + "KE110 Gel" (30%)<br>(4) Cobalt naphthenate | 0.53 | 0.01 | 1.32 | 7.2 | 88 |
| 20 | (1) Carbon Black<br>(2) "KE108"<br>(3) "X22-5002" | 0.38 | 0.01 | 1.33 | 6.3 | 90 |

EXAMPLE 21

The following components were dispersed in a ball mill for 48 hours, whereby an image fixing and oil absorption layer formation liquid was prepared:

| | Parts by Weight |
|---|---|
| Titanium oxide | 100 |
| Isopropyl alcohol | 500 |
| Calcium oleate | 30 |
| Silane coupling agent | 50 |

The thus prepared image fixing and oil absorption layer formation liquid was coated with a thickness of 3 μm on a sheet of high quality paper, whereby an image transfer sheet was prepared.

A liquid recording material was prepared by the same procedure of producing the liquid recording material No. 1 as in Example 1 except that the reactive silicone material (™ "X22-5002", made by Shin-Etsu Chemical Co., Ltd.) employed in Example 1 was replaced by a reactive silicone "KF99" ™, made by Shin-Etsu Chemical Co., Ltd.

By use of this liquid recording material, images were formed, on the above prepared image transfer sheet, using the same commercially available electrophotographic copying machine (™ "RICOPY FT-400i", made by Ricoh Co., Ltd.) as mentioned above. As a result, copy images with an image density of 1.28, a background density of 0.01, and a resolution of 7.2 lines/mm were obtained. The image fixing ratio of the images was 87%.

Even immediately after making copies, no smearing was caused in the copies made.

EXAMPLE 22

By use of the liquid recording material No. 3 prepared in Example 3, an image was formed and was then subjected to flash image fixing, using a commercially available electrophotographic copying machine (™"RICOPY FT-400i", made by Ricoh Co., Ltd.) which was modified to be capable of performing the flash image fixing. As a result, images were formed with a background density of 0.01, an image density of 1.36, a resolution of 9.2 lines/mm, and an image fixing ratio of 92%.

EXAMPLE 23

The liquid recording material No. 17 prepared in Example 17 and the liquid recording material No. 18 prepared in Example 18 were each used as a printing ink for a commercially available simplified printer "PRIPORT" ™, made by Ricoh Co., Ltd. The result was that both the liquid recording materials No. 17 and No. 18 exhibited excellent image fixing performance and image quality.

EXAMPLE 24

The liquid recording material No. 2 prepared in Example 2 was evaluated, using a voltage application type ink jet system. The result was that images with an image density of 1.26, and an image fixing ratio of 70% were obtained.

Japanese Patent Application No. 11-003488 filed Jan. 8, 1999, is hereby incorporated by reference.

What is claimed is:

1. A liquid recording material comprising a resin, a coloring agent, and a carrier liquid comprising a reactive silicone material.

2. The liquid recording material as claimed in claim 1, wherein said reactive silicone material comprises a reactive silicone compound that contains in the molecule thereof at least one group selected from the group consisting of vinyl group, amino group, hydroxyl group, epoxy group, isocyanate group, and an active hydrogen.

3. The liquid recording material as claimed in claim 1, wherein said resin comprises said reactive silicone material.

4. The liquid recording material as claimed in claim 3, wherein said reactive silicone material comprises a silicone RTV rubber.

5. The liquid recording material as claimed in claim 1, wherein said coloring agent comprises said reactive silicone material.

6. The liquid recording material as claimed in claim 5, wherein said reactive silicone material comprises a silicone RTV rubber.

7. The liquid recording material as claimed in claim 1, wherein said reactive silicone material comprises a silicone RTV rubber.

8. The liquid recording material as claimed in claim 1, wherein said carrier liquid comprises said reactive silicone material and a polymerizable vinyl monomer, with the weight ratio of said reactive silicone material:

said polymerizable vinyl monomer being in a range of (0.01 to 9): 1.

9. The liquid recording material as claimed in claim 1, wherein said carrier liquid comprises said reactive silicone material and an aliphatic hydrocarbon.

10. The liquid recording material as claimed in claim 1, wherein said carrier liquid comprises said reactive silicone material and a vegetable oil.

11. The liquid recording material as claimed in claim 1, wherein said carrier liquid comprises said reactive silicone material and a synthetic oil.

12. The liquid recording material as claimed in claim 1, wherein said carrier liquid comprises said reactive silicone material and a silicone oil.

13. The liquid recording material as claimed in claim 1, wherein said carrier liquid further comprises a polymerization initiator.

14. The liquid recording material as claimed in claim 1, wherein said carrier liquid further comprises at least one component selected from the group consisting of a gelling agent and a cross-linking agent.

15. The liquid recording material as claimed in claim 1, wherein said coloring agent is one coloring agent selected from the group consisting of a yellow coloring agent, a magenta coloring agent, a cyan coloring agent, and a black coloring agent.

16. The liquid recording as claimed in claim 15, wherein said yellow coloring agent comprises a disazo pigment, said magenta coloring agent comprises a quinacridone pigment or a carmine pigment, said cyan coloring agent comprises copper phthalocyanine, and said black coloring agent comprises carbon black.

17. The liquid recording material as claimed in claim 1, further comprising at least one component selected from the group consisting of an oxidizing agent, a reducing agent, an esterification agent, a coupling agent, a gelling agent, and a polymerization initiator.

18. A method of fixing an image developed by using a liquid recording material comprising a resin, a coloring agent, and a carrier liquid comprising a reactive silicone material, on an image transfer material comprising at least on the surface thereof at least one component selected from the group consisting of an oxidizing agent, a reducing agent, an esterification agent, a coupling agent, a gelling agent, and a polymerization initiator, with the application of corona charge thereto as an external stimulus.

* * * * *